United States Patent [19]

Schwarz

[11] 4,379,400

[45] Apr. 12, 1983

[54] TUBE BENDER CONSTRUCTION

[75] Inventor: Albert J. Schwarz, Lincolnwood, Ill.

[73] Assignee: Imperial Clevite Inc., Rolling Meadows, Ill.

[21] Appl. No.: 229,864

[22] Filed: Jan. 30, 1981

[51] Int. Cl.[3] ..... B21D 9/05

[52] U.S. Cl. ..... 72/388

[58] Field of Search ..... 72/459, 458, 457, 388, 72/387, 217, 461, 32, 33, 34, 35, 36

[56] References Cited

U.S. PATENT DOCUMENTS

| | | | |
|---|---|---|---|
| 1,324,670 | 12/1919 | Hawes | 72/459 |
| 2,455,138 | 11/1948 | Perkins | 72/32 |
| 2,719,561 | 10/1955 | Bizak | 72/32 |
| 2,796,785 | 6/1957 | Philippe | 72/388 |
| 2,887,917 | 5/1959 | Kowal | 72/388 |
| 2,986,195 | 5/1961 | Landis | 72/32 |
| 3,750,447 | 8/1973 | Kowal | 72/459 |
| 3,789,640 | 2/1974 | Frank | 72/36 |
| 3,926,028 | 12/1975 | Kowal | 72/388 |

FOREIGN PATENT DOCUMENTS

| | | | |
|---|---|---|---|
| 736855 | 9/1955 | United Kingdom | 72/34 |

*Primary Examiner*—Gene Crosby

*Attorney, Agent, or Firm*—Wood, Dalton, Phillips, Mason & Rowe

[57] ABSTRACT

A tube bender construction for manual operation in bending a tube. The tube bender includes a mandrel defining a bending groove into which the tube is urged by a forming member mounted to the mandrel to swing about a bending axis of the bending groove. The tube to be bent is held against longitudinal movement during the bending operation by tube holding structure arranged to retain the tube against such movement. Movement of the forming member about the bending axis is effected by manipulation of a pair of handles. The mandrel defines an extension adapted for adjustably mounting the tube holding hook to further define structure for adjusting the disposition of the tube to be bent to be accurately tangential to the bending groove at a bend start position thereof.

9 Claims, 5 Drawing Figures

TUBE BENDER CONSTRUCTION

BACKGROUND OF THE INVENTION

1. Field of the Invention

This invention relates to tube benders and in particular to manually operable tube benders wherein a forming member is swung about a mandrel bending axis by means of a handle associated therewith and a handle mounted to the mandrel.

2. Description of the Background Art

Manually operable tube benders are well known in the art. One improved form of such tube bender is illustrated in U.S. Pat. No. 2,796,785 of Howard L. Philippe. As shown therein, a shoe forming member is provided with a handle. The shoe is swingably mounted to a mandrel for pivotal movement about a bending axis. A second handle is connected to the mandrel. A hook is swingably mounted on the second handle for engaging the tube at a point adjacent the bent start point of a groove in the periphery of the mandrel into which the tube is urged in the bending operation.

Further improved tube benders are illustrated in U.S. Pat. Nos. 2,887,917 and 3,926,028 of Leonard J. Kowal. In U.S. Pat. No. 2,887,917, a tube bender is illustrated wherein the hook is pivotally mounted to one of the handles.

In Kowal U.S. Pat. No. 3,926,028, the tube bender is provided with a vise mounting portion in lieu of the handle secured to the mandrel. In one form, the hook is formed integrally with the male clamp portion, and in a second form, the hook is pivotally mounted thereon.

In U.S. Pat. No. 3,750,447 of Leonard J. Kowal and William R. Saddler, a further improved tube bender is illustrated having fixed hook means with a cutout space being provided in confrontation to the hook to permit facilitated installation of the tube to be bent into the tool, notwithstanding the fixed relationship of the hook to the mandrel.

SUMMARY OF THE INVENTION

The present invention comprehends an improved manually operable tube bender construction having adjustable means for positioning the tube to be bent accurately tangential to the bend starting position of the mandrel bending groove.

More specifically, the invention comprehends the provision of such adjusting means integral with the tube holding hook means.

In the exemplary embodiment, the hook is adjustably secured to an extension of the mandrel to effect the desired tube positioning.

More specifically, the hook is provided with a connecting portion and means are associated with the connecting portion and mandrel for locking the hook to the mandrel in adjusted disposition.

In the illustrated embodiment, the securing means comprises threaded means extending through a slot in the hook connecting portion and threaded to the mandrel extension.

The bending tool is arranged to define a clearance space adjacent the space in which the tube is positioned when engaged by the hook so as to permit the tube to be readily installed in the tube bending tool notwithstanding the fixed association of the hook with the mandrel.

Indicating means may be provided on the mandrel and forming element of the tube bending tool for indicating the accurate tangential relationship of the tube relative to the bend start point of the mandrel bending groove.

The tube positioning means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
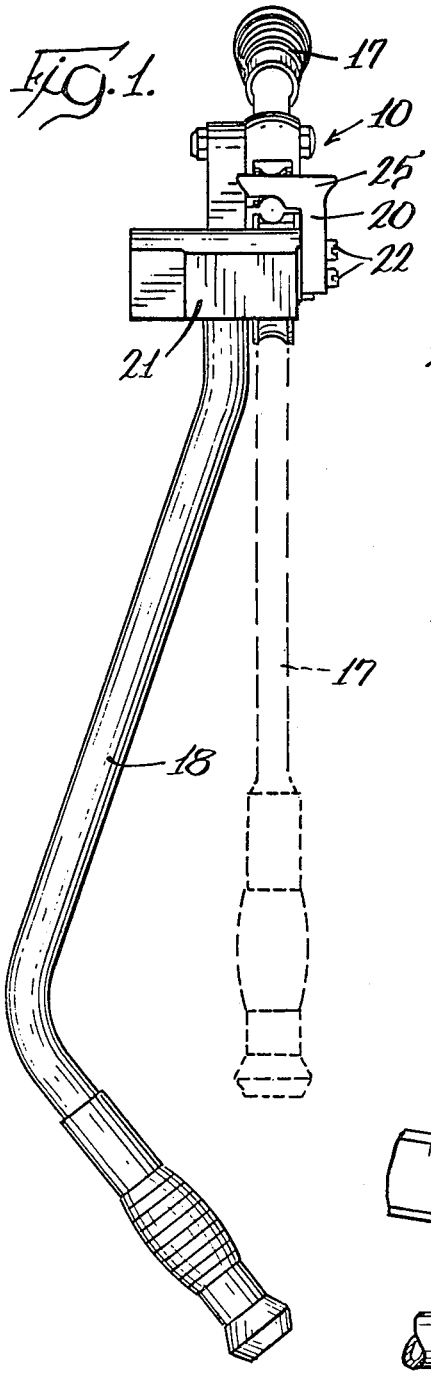
FIG. 1 is an elevation of a tube bender embodying the invention.

In the exemplary embodiment of the invention as disclosed in the drawing, a manually operable tube bender generally designated 10 is shown to include a mandrel 11 defining an annular peripheral bending groove 12. A tube to be bent T is bent into the forming groove by a forming member 13 which is swung about a bending axis 14 of the groove 12 by its connection to the mandrel through a link 15. The tube to be bent is held against longitudinal movement during the bending operation by a holding means generally designated 16.

Movement of the forming member 13 about axis 14 is effected by suitable manipulation of a pair of handles 17 and 18 connected respectively to the forming member 13 and mandrel 11.

Figure 2:
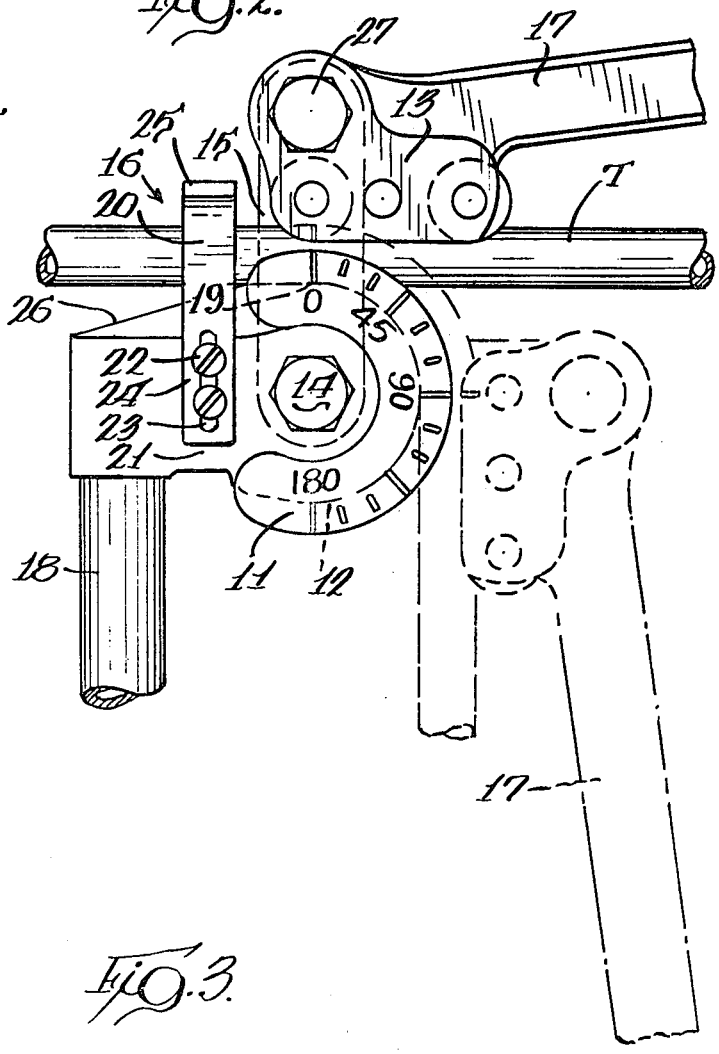
FIG. 2 is a fragmentary side elevation thereof, with the forming member shown in a 90° bend position in broken lines.

As seen in FIG. 2, the bending groove 12 defines a bend start position 19. The tube T to be bent is arranged to extend tangentially to the bending groove at bend start point 19, as illustrated in FIG. 2, i.e. perpendicular to a radius from the axis 14 through the bend start point. Holding means 16, in the illustrated embodiment, is defined by a hook 20 adjustably fixedly secured to an extension 21 of mandrel 11 by suitable means, such as screw 22 extending through a slot 23 in a connection portion 24 of the hook for fixedly clamping the connecting portion to the mandrel extension so as to adjustably lock a tube engaging portion 25 of the hook in the position of FIGS. 1 and 2 wherein the tube T does extend in the desired tangential manner to the mandrel groove at the bend start position 19.

As shown in FIG. 2, the mandrel extension may define a recessed portion 26 permitting the tube to be inserted between the forming member 13 and the mandrel, including the extension, with the forming member 13 swung upwardly from the position of FIG. 2 about a pivot connection 27 of the forming member to the link 15. Thus, when the forming member 13 is swung back down to the bend start position of FIG. 2, the tube is automatically brought into engagement with the tube engaging portion 25 of hook 20, which, as discussed above, accurately positions the tube in the desired tangential arrangement.

As will be obvious to those skilled in the art, other suitable means may be utilized for adjustably securing the hook to the mandrel within the scope of the invention.

In use of the tube bender, portions thereof may become worn so as to provide play. Such play may provide a loose retention of the tube between the forming member 13 and mandrel 11 such as illustrated in full lines in FIG. 4. Thus, because of excessive clearance between the forming member 13 and mandrel 11, the tube is loosely retained therebetween, permitting it to pivot in the bending groove so as to no longer be accurately tangential to the bending groove at the bend start point 19.

Figure 4:
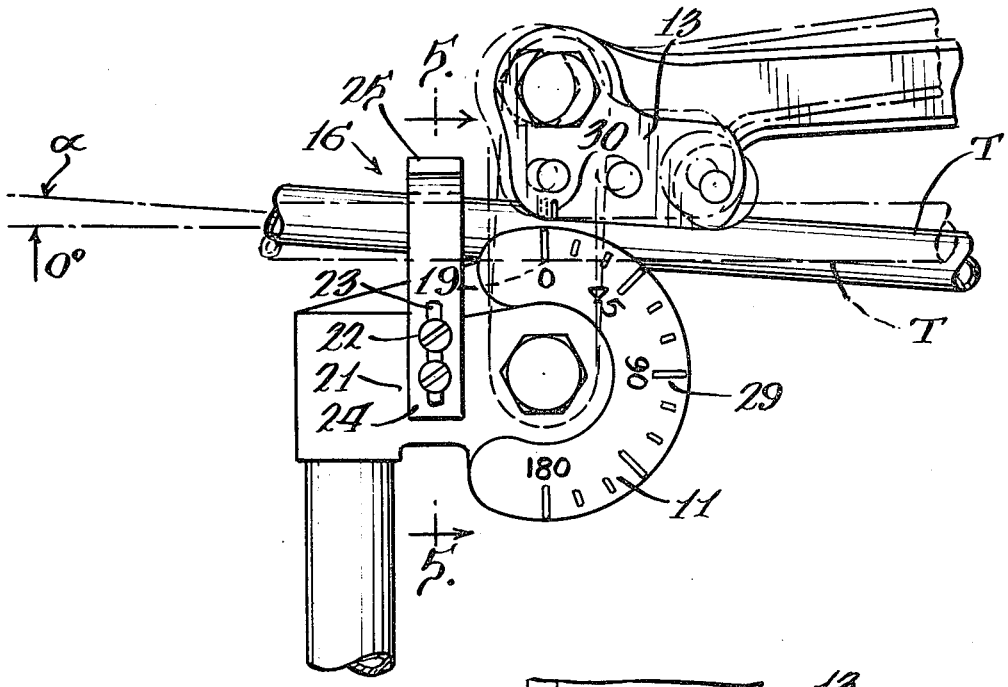
FIG. 4 is an elevation similar to that of FIG. 1 but illustrating the selective positioning of the hook for adjusting the angular disposition of the tube to be bent.
Figure 5:
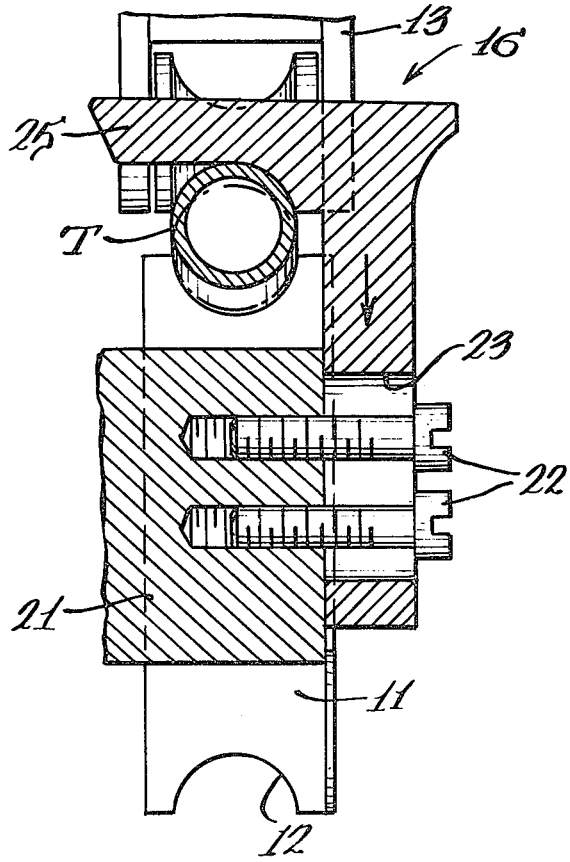
FIG. 5 is a transverse section taken substantially along the line 5—5 of FIG. 4.

The improved tube holding means 16 herein permits the fixed hook to be repositioned so as to bring the tube engaging portion 25 downwardly from the full line position of FIG. 4 to swing the tube T from the angled disposition shown in full lines therein to the dotted line position wherein the tube again extends accurately tangentially to the bending groove at the bend start point 19. This is accomplished by suitably loosening screw 22, moving the hook downwardly to swing the tube back to the tangential position, and then tightening screw 22 to clamp the hook connecting portion 24 again to the mandrel extension 21.

Figure 3:
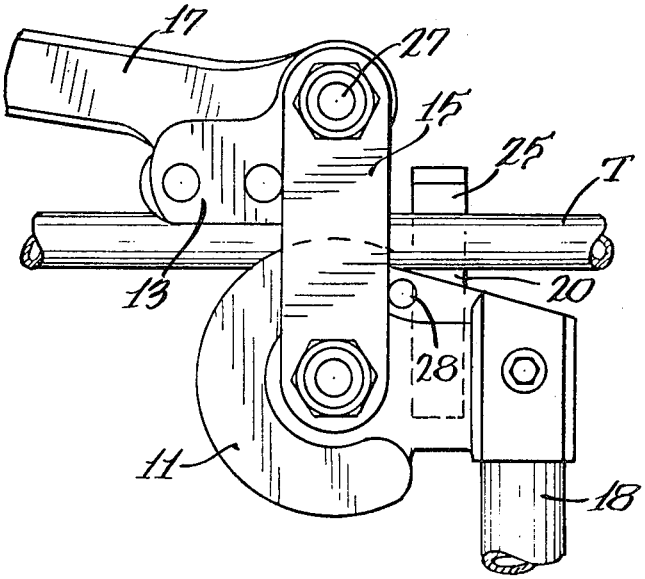
FIG. 3 is a fragmentary rear elevation thereof.

The accurate positioning of the tube T in the desired tangential position may be ascertained by determining whether any looseness in the tube occurs when the forming member 13 is swung to the bend start position illustrated in FIG. 3, wherein the link 15 is abutted with a stop pin 28. Thus, with the forming member 13 disposed in the bend start position of FIG. 3, desired takeup on the hook position causes the tube T to have no angular play in a clockwise direction as from the dotted line position of FIG. 4 toward the full line position thereof. Resultingly, the tube is accurately positioned to be tangential to the bending groove at the bend start point and movement of the forming member 13 about the mandrel to progressively urge the tube T into the mandrel groove 12 provides an accurate, angular extension of the bend, as determined by the scale 29 provided on the mandrel and a cooperating indicium mark 30 on the forming member 13.

Thus, the adjustable holding means 16 defines means for effectively positively retaining the tube T against longitudinal displacement and assuring that the tube extends accurately tangentially to the bending groove at the bend start position to provide an accurate bend of a desired angularity, such as 90°, 180°, etc.

As will be obvious to those skilled in the art, the invention comprehends the provision of a tube retaining means having such desirable adjustability for repositioning the tube T in the accurate tangential position wherein the hook is pivotally mounted to the mandrel as well as in the illustrated embodiment wherein the hook is fixedly mounted thereto. Thus, the invention comprehends a novel arrangement of the hook tube retaining means to not only retain the tube against longitudinal displacement during the bending operation, but also to assure accurate disposition of the tube relative to the bend start position.

In use, the operator installs the tube T in the tube bender, as illustrated in FIG. 2, with the tube extending tangentially to the bending groove 12 at the bend start point 19. As discussed above, in the event the tube does not extend tangentially to the bending groove at bend start point 19, suitable adjustment of hook 20 may be made to bring the tube into such alignment. The hook 20 engages the tube to lock the tube against longitudinal movement during the bending operation. During the installation of the tube, handle 17 is swung in a counterclockwise direction from the position of FIG. 2 to space the forming means 13 from the mandrel, permitting facilitated installation of the tube T. As indicated above, the recess portion 26 permits the tube T to be installed between the forming member 13 and mandrel, notwithstanding the fixed mounting of the hook to the mandrel.

The handle 17 is then swung in a clockwise direction to the full line position of FIG. 2. Suitable manipulation of handles 17 and 18 is then effected to move the forming means 13 circumferentially about the mandrel to effect a bending of the tube into the groove 12 to the desired angular extent.

Illustratively, as shown in broken lines in FIG. 2, the forming member may be swung approximately 90 degrees from the full line position thereof to effect a bend in the tube T extending accurately 90° from the bend start position 19.

The foregoing disclosure of specific embodiments is illustrative of the broad inventive concepts comprehended by the invention.

I claim:

1. In a tube bender having a mandrel defining a bending groove extending arcuately in a first direction from a bend start point, a tube retaining space adjacent said bend start point in a second direction opposite said first direction, and forming means swingable about the mandrel for urging a tube to be bent progressively into the bending groove, improved means for holding the tube against longitudinal displacement during a bending operation comprising:

a tube holding member having a tube engaging portion and a mounting portion; and slidable lockable means for mounting the tube holding member in association with the mandrel with the tube engaging portion being position in a selected one of a plurality of infinitely different fixed positions transversely to a tangent to said bending groove at said bend start point extending through said tube retaining space for urging a tube portion, engaged by the tube holding member and extending from said bend start point to said tube retaining space, infinitely adjustably pivotally about the mandrel at said bend start point to an angular disposition accurately tangential to the bending groove at said bend start point.

2. The tube bender of claim 1 wherein said means for mounting the tube holding member comprises means for clamping said mounting portion thereof to said mandrel.

3. The tube bender of claim 1 further including means on said mandrel and forming means for indicating the disposition of the tube in said accurately tangential disposition.

4. The tube bender of claim 1 wherein said tube holding member is adjustably positionable in a direction perpendicular to said tangent.

5. The tube bender of claim 1 wherein the tube bender structure defines an inner open space adjacent said tube retaining space for receiving a portion of the tube to be bent during placement of the tube into the mandrel groove between the mandrel and forming means at the start of the bending operation, said tube engaging portion of the tube holding means being disposed outwardly of said tube retaining space.

6. The tube bender of claim 1 wherein said means for mounting the tube holding member comprises means for fixedly mounting the tube holding member in association with the mandrel.

7. The tube bender of claim 1 wherein said holding member comprises a hook, said tube being free of support in the direction of application of tube retaining force by the hook to the tube at said tube retaining space.

8. The tube bender of claim 1 wherein said mandrel and forming means are provided with means for causing the tube to be bent to be retained against angular displacement from the tangential relationship to said groove at the bend start point upon the tube holding member positioning the tube in said tangential relationship.

9. In a tube bender having a mandrel defining a bending groove extending arcuately in a first direction from a bend start point, a tube retaining space adjacent said bend start point in a second direction opposite said first direction, and forming means swingable about the mandrel for urging a tube to be bent progressively into the bending groove, improved means for holding the tube against longitudinal displacement during a bending operation comprising:

a tube holding member having a tube engaging portion and a mounting portion; and means for fixedly mounting the tube holding member in association with the mandrel with the tube engaging portion being positioned in any one of a plurality of different positions transversely to a tangent to said bending groove at said bend start point extending through said tube retaining space for urging a tube portion extending from said bend start point to said tube retaining space pivotally about the mandrel at said bend start point to a disposition accurately tangential to the bending groove at said bend start point, said means for fixedly selectively mounting the tube holding member comprising a portion of said mounting portion defining a slot elongated transversely to said tangent and threaded securing means extending through the slot for locking the tube holding member in adjusted disposition to the mandrel.

* * * * *